US011265632B1

(12) United States Patent
Au et al.

(10) Patent No.: US 11,265,632 B1
(45) Date of Patent: Mar. 1, 2022

(54) SPEAKER-INTEGRATION SYSTEM FOR AN ELECTRONIC DEVICE, AND ASSOCIATED DEVICES AND SYSTEMS

(71) Applicant: Google LLC, Mountain View, CA (US)

(72) Inventors: Cindy Ngoc-Tran Au, Milpitas, CA (US); Gordon Robert Dix, Newark, CA (US); Luis Chau, Concord, CA (US); William Raeming Dong, Redwood City, CA (US); Laurie Man Sum Kwan, San Francisco, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/154,323

(22) Filed: Jan. 21, 2021

(51) Int. Cl.
*H04R 1/02* (2006.01)

(52) U.S. Cl.
CPC ..... *H04R 1/025* (2013.01); *H04R 1/021* (2013.01); *H04R 1/023* (2013.01); *H04R 1/026* (2013.01)

(58) Field of Classification Search
CPC ..... H04R 1/025; H04R 1/021; H04R 1/023; H04R 1/026
USPC ..... 381/386
See application file for complete search history.

(56) References Cited

U.S. PATENT DOCUMENTS 8,688,174 B2 * 4/2014 Latham ..... H04M 1/0258 455/569.1
2008/0080730 A1 * 4/2008 Takakusaki ..... H04R 5/02 381/300
2011/0235846 A1 * 9/2011 Jiang ..... G11B 33/025 381/386
2011/0261986 A1 * 10/2011 Murayama ..... G01M 3/26 381/332
2016/0205465 A1 7/2016 Slotte et al.

FOREIGN PATENT DOCUMENTS

WO 1994003377 2/1994

OTHER PUBLICATIONS

"Sonos Bulb UCSB Capstone Project", UC Santa Barbara Engineering, Accessed online at: https://web.ece.ucsb.edu/Faculty/Johnson/ECE189/final/bulb.pdf on Sep. 17, 2020, Jun. 2, 2016, 54 pages.

* cited by examiner

*Primary Examiner* — Sean H Nguyen
(74) *Attorney, Agent, or Firm* — Colby Nipper PLLC

(57) ABSTRACT

This document describes a speaker-integration system and associated devices and systems. The speaker-integration system includes a speaker that is re-workably mounted, via an elastomeric gasket, to an intermediate structure that is mountable to an outer enclosure of an electronic device. The intermediate structure forms a cavity in which the speaker is sealed, effective to use the cavity as the speaker's back volume to contain acoustic waves without impacting other structures in the electronic device. The front of the speaker is sealed against the outer enclosure by a gasket that controls, based on its placement and geometry, axial and radial directions of the speaker relative to the intermediate structure to prevent the speaker from buzzing against surrounding rigid parts. The speaker has wires that exit the back volume via a detachable grommet, which controls positioning of the wires to prevent rub and buzz against surrounding parts.

23 Claims, 13 Drawing Sheets

Section A–A

Section D-D

SPEAKER-INTEGRATION SYSTEM FOR AN ELECTRONIC DEVICE, AND ASSOCIATED DEVICES AND SYSTEMS

BACKGROUND

As technology evolves, balancing production costs against performance of an electronic device can be challenging. In many consumer products, including camera products with speakers, the effort to lower cost has led to two general trends for speaker integration. One trend includes the prevalence of additional mechanical and electromechanical components and structures being tightly packed around the speaker. Such an arrangement of additional components and structures may introduce a risk of "rub and buzz," which is a type of acoustic distortion that degrades the sound quality of the speaker. Another trend includes the prevalence of adhesive (e.g., glue) as the primary method of speaker integration to the product. Such adhesives, however, can significantly lower the yield, repeatability, and serviceability of the product.

SUMMARY

This document describes a speaker-integration system for an electronic device and associated devices and systems. The speaker-integration system includes a speaker that is re-workably mounted, via an elastomeric gasket, to an intermediate structure (e.g., heatsink) that is mountable to a main enclosure of an electronic device. The intermediate structure forms a cavity in which the speaker is sealed, effective to use the cavity as the speaker's back volume to contain acoustic waves without impacting other structures in the electronic device. The front of the speaker is sealed against the main enclosure by a gasket that controls, based on its placement and geometry, axial and radial directions of the speaker relative to the intermediate structure to prevent the speaker from buzzing against surrounding rigid parts. The speaker has wires that exit the back volume via a detachable grommet, which controls positioning of the wires to prevent rub and buzz against surrounding parts.

The speaker-integration system enables the speaker to be integrated into the electronic device in a manner that is re-workable, serviceable, and low cost (e.g., does not require replacement of parts or labor to remove adhesive). Because the gasket is compressed via the mounting of the intermediate structure to the main enclosure, the number of fasteners required for mounting is reduced. The intermediate structure may also be used for heat dissipation.

In aspects, a speaker-integration system for an electronic device is disclosed. The speaker-integration system includes an intermediate structure, a speaker, a grommet, and a gasket. The intermediate structure is mountable to an outer enclosure of the electronic device, with the intermediate structure forming a cavity. The speaker is positioned within the cavity of the intermediate structure and oriented to use the cavity as a speaker back volume. The grommet is removably positioned within a hole in a wall of the cavity of the intermediate structure. The grommet is configured to form a seal around one or more speaker wires passing through the hole. The gasket is removably positioned to secure the speaker within the cavity. In addition, the gasket is configured to (i) form a seal around the speaker at an opening of the cavity to seal the opening of the cavity and (ii) form a seal between the intermediate structure and the outer enclosure.

In other aspects, an electronic device is disclosed. The electronic device includes an outer enclosure, an intermediate structure, a speaker, a gasket, and a grommet. The outer enclosure forms a shell with a cap. The intermediate structure is positioned within the outer enclosure, has an outer surface that substantially conforms to a shape of an inner surface of the outer enclosure, and defines a cavity that is open toward the cap. The speaker is positioned within the cavity and faces the cap of the outer enclosure. The gasket has an outer ring that extends radially outward from an inner ring of the gasket. The outer ring has a first compressible region on a first surface and a second compressible region on a second surface that is opposite the first surface, where the first and second compressible regions are configured to be compressed between the outer enclosure and the intermediate structure to form a first seal. The gasket also has a third compressible region on the inner ring and is configured to be compressed between the outer enclosure and the speaker to form a second seal. In addition, the gasket includes one or more clips configured to grip a portion of the speaker to control a position and orientation of the speaker within the cavity. The grommet is positioned within a hole in the intermediate structure and forming a third seal, the grommet wrapped around one or more speaker wires extending through the hole.

This summary is provided to introduce simplified concepts of a speaker-integration system for an electronic device, which is further described below in the Detailed Description. This summary is not intended to identify essential features of the claimed subject matter, nor is it intended for use in determining the scope of the claimed subject matter.

BRIEF DESCRIPTION OF THE DRAWINGS

The details of one or more aspects of a speaker-integration system for an electronic device are described in this document with reference to the following drawings. The same numbers are used throughout the drawings to reference like features and components.

DETAILED DESCRIPTION

This document describes a speaker-integration system for an electronic device and associated devices and systems. The speaker-integration system provides a way to integrate a speaker into an electronic device by utilizing an intermediate structure, such as a heatsink, to form a cavity in which the speaker is suspended by a gasket. The cavity is sealed at its front by the gasket, based on a compression force between the intermediate structure and an outer enclosure of the electronic device. The cavity is sealed at its back by a grommet wrapped around speaker wires of the speaker extending from the speaker and through a hole in a cavity wall of the intermediate structure. In this way, the cavity is utilized as a speaker back volume, the speaker is constrained within the cavity in its axial and radial directions by the gasket to prevent the speaker from rubbing and buzzing against the cavity walls, and the speaker wires are constrained by the grommet to prevent the speaker wires from rubbing and buzzing against the cavity walls or against rigid other components of the electronic device outside of the cavity. The gasket and the grommet enable the speaker-integration system to be re-workable, serviceable, and low cost.

While features and concepts of the described speaker-integration system for an electronic device and associated devices and systems can be implemented in any number of different environments, aspects are described in the context of the following examples.

Example Device

Figure 1:
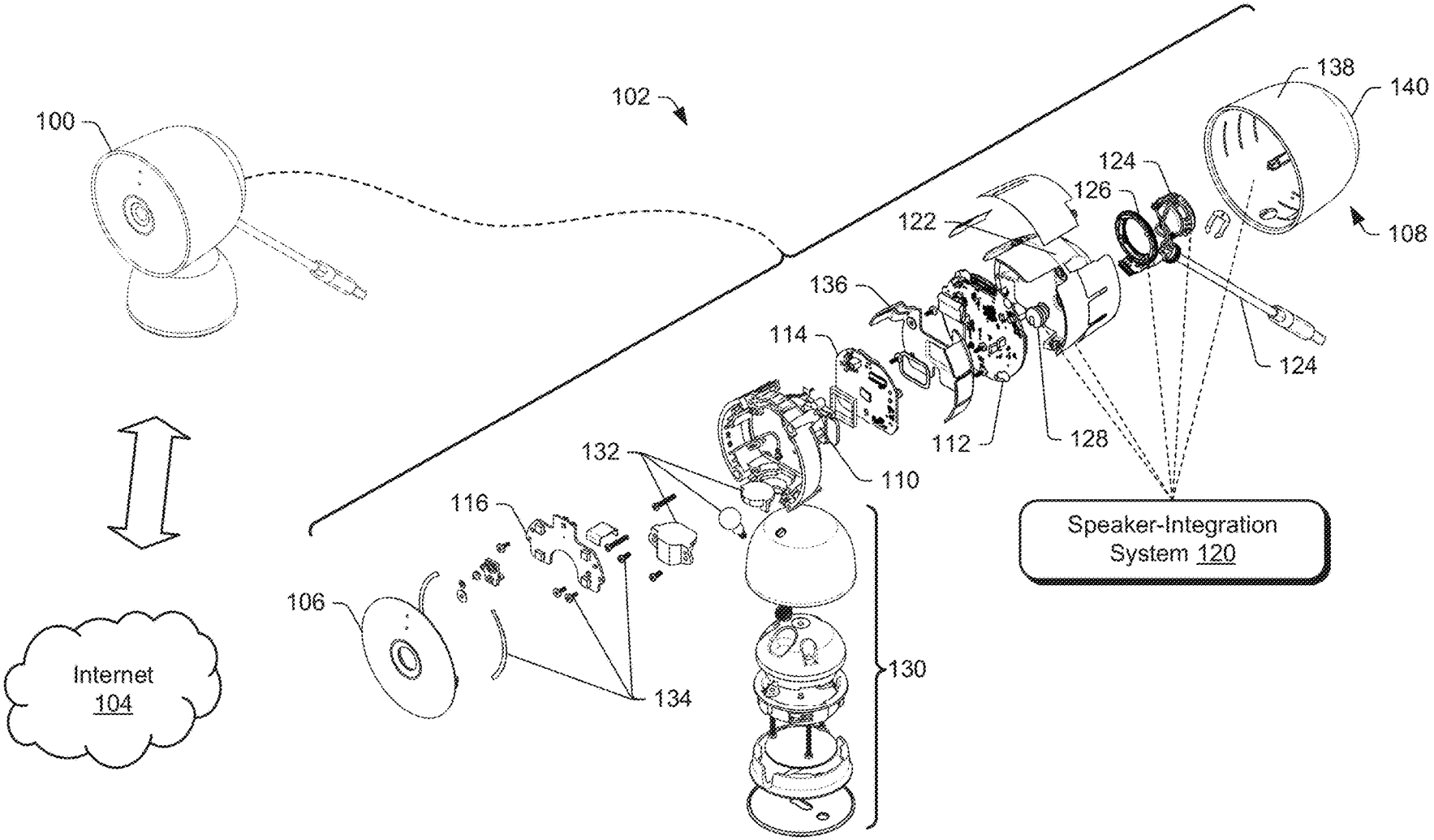
FIG. 1 illustrates an example electronic device and an exploded view of some components thereof, which may include an example speaker-integration system.

FIG. 1 illustrates an example electronic device 100 (e.g., a security camera) and an exploded view 102 of some components thereof, which may include an example speaker-integration system. The electronic device 100, in some aspects, may use a voice-activated virtual assistant. The electronic device 100 may connect to the Internet 104 (e.g., through a wireless router) and support a variety of functions, including capturing audio and/or video data (including images or streaming video), transmitting the captured data to online storage, storing the captured data to local memory, streaming audio (e.g., music, news, podcasts, sports), and interacting with a virtual assistant to perform tasks (e.g., search the internet, schedule events and alarms, control home automation, control internet-of-things (IoT) devices), and so on.

The electronic device 100 includes a housing formed by one or more housing members, including a front cover 106 and an outer enclosure 108 (e.g., a head housing). The electronic device 100 may also include a camera subassembly 110 and multiple printed circuit boards (PCBs), including at least a main logic board (MLB) 112, a camera board 114, and an infrared (IR) board 116. Additional PCBs may also be used.

The PCBs may include various integrated circuit (IC) components, including system-on-chip (SoC) IC devices, processors, and IC components for light-emitting diode(s) (LEDs), microphone(s), or sensors for detecting input such as touch-input, a button-press, or a voice command. In aspects, the electronic device 100 may include cable 118 (e.g., "power cable") electrically connected to the MLB 112 to provide power to various components of the electronic device 100. The PCBs (e.g., the main logic board 112, the camera board 114, the IR board 116) may be formed, for example, from glass-reinforced epoxy material such as FR4. In some instances, the PCBs may include a single layer of electrically conductive traces and be a single-layer board. In other instances, the PCBs may be a multi-layer board that includes multiple layers of electrically conductive traces that are separated by layers of a dielectric material.

The electronic device 100 may also include speaker-integration system 120, which may include an intermediate structure 122 (e.g., heatsink), a speaker 124, a gasket 126, a grommet 128, and the outer enclosure 108. The electronic device 100 may also include a stand assembly 130. In some aspects, the electronic device 100 may include hinge components 132 forming a hinge, such as a generally spherical ball joint formed by a stem (e.g., ball stem), a bracket (e.g., ball stem bracket), and a boot (e.g., ball stem boot). The electronic device 100 may further include removable assembly components, such as fasteners 134 (e.g., screws, bolts, adhesive, pressure-sensitive adhesive (PSA)). In addition to the intermediate structure 122 being used as a heatsink, the electronic device 100 may include one or more additional thermal-control components (e.g., heat spreader 136, thermal interface materials (TIMs) such as thermal gel, thermal paste, thermal adhesive, thermal tape) with high thermal conductivities.

The intermediate structure 122 and the heat spreader 136 may be implemented to transfer and spread energy from heat-dissipating components on the PCBs, including SoC IC devices, memory devices, processors, and so forth. The heat spreader 136 may be positioned between the main logic board 112 and the camera board 114 to transfer and spread heat generated by one or more heat-generating IC components (e.g., SoC IC component, memory IC components, audio amplifiers, and audio inductors) on the main logic board 112 and/or on the camera board 114. The intermediate structure 122 may be positioned proximate to the main logic board 112 to transfer and spread heat generated by one or more heat-generating IC components on the main logic board 112 toward a back end and lateral sides of the electronic device 100.

The housing members (e.g., the front cover 106 and the outer enclosure 108) may include a plastic material and be formed, for example, using plastic-injection molding techniques. The housing members may include any suitable geometry, including the example geometry illustrated in FIG. 1. For instance, the outer enclosure 108 may form a shell 138 (e.g., a hollow cylinder or generally cylindrical shell) with a cap 140 (e.g., a generally spherical cap) at one end of the cylinder. The outer enclosure 108 includes a tapering diameter of the shell 138 that is capped at the back end by the cap 140. This leaves an opposing end of the shell 138 open. In this way, the outer enclosure 108 forms a general cup shape with an open end and an opposing, rounded, closed end. Although the examples described herein illustrate a generally cylindrical shell and a generally spherical cap, alternate shapes may also be implemented for the shell and cap. For example, the outer enclosure 108 may form an oblong shell or any other suitably-shaped shell, with a cross-section having any suitable shape, including an oval shape, a square shape, a rectangular shape, a triangular shape, or an asymmetrical shape.

The outer enclosure 108 defines a cavity for housing various components of the electronic device 100, including the speaker-integration system 120. In the illustrated example, the outer enclosure 108 is a single, solid part, which is smooth (seamless) and cosmetically designed, but also enables manufacturing at low cost. Alternatively, the outer enclosure 108 may include multiple parts assembled together. The front cover 106 may form a general disk-shaped object that covers the open front end of the shell. The front cover 106 may also include an aperture or transparent region that is aligned with the camera subassembly 110 to enable the camera subassembly 110 to view through the aperture or transparent region and capture images or video of a scene.

The stand assembly 130 may include a variety of components assembled together to support the electronic device 100. In aspects, the stand assembly 130 may be removably connected to the stem of the hinge formed by the hinge components 132. The stand assembly 130 includes a base that may be mounted to any suitable surface, such as a wall, a table, or a ceiling to support the electronic device 100.

Example Speaker-Integration System

Figure 2:
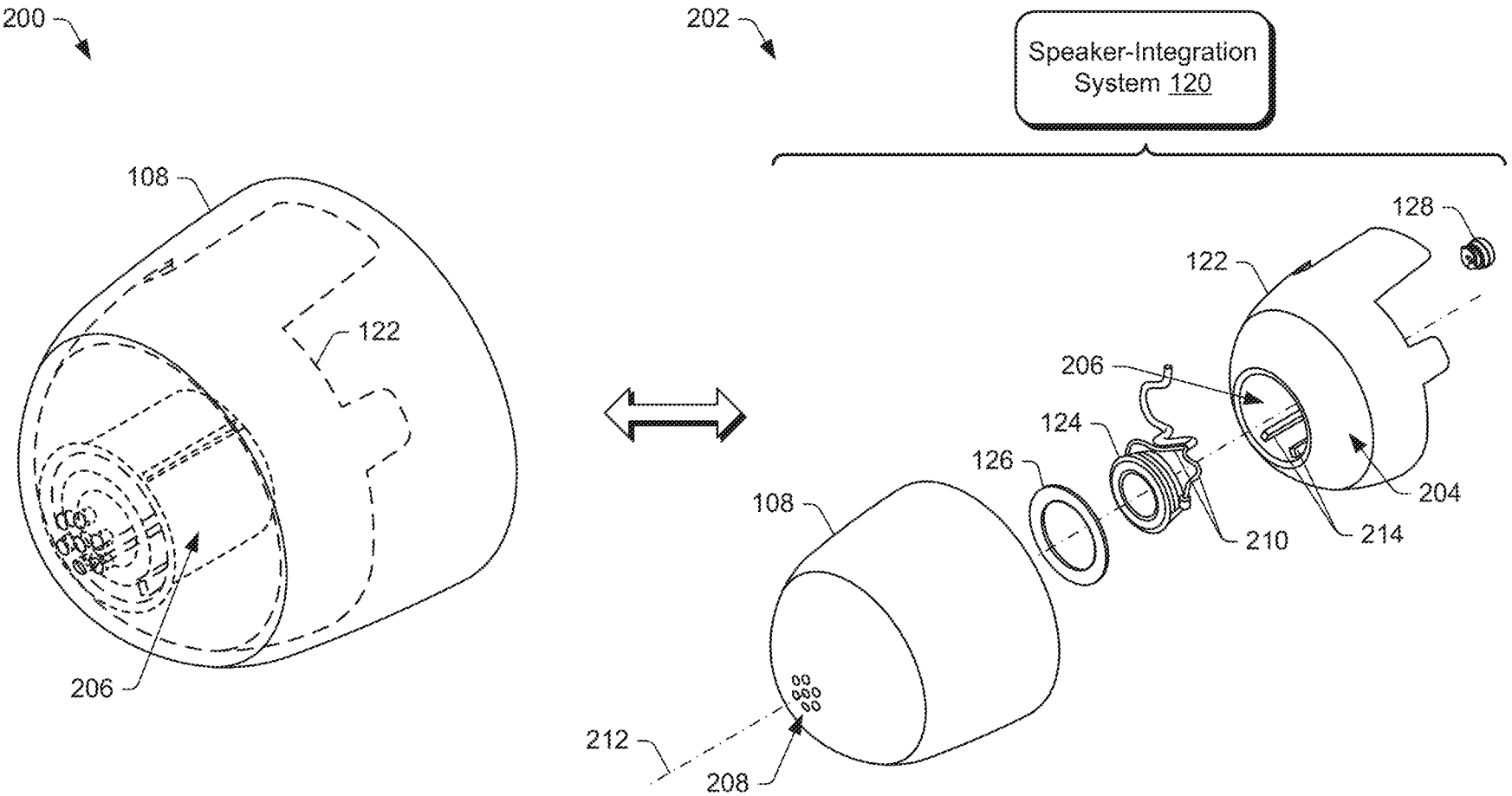
FIG. 2 illustrates a rear isometric view and an exploded view of an example implementation of the speaker-integration system from FIG. 1.

FIGS. 2-14 illustrate various views of the speaker-integration system 120, and components thereof, from FIG. 1, in accordance with one or more aspects. FIG. 2 illustrates a rear isometric view 200 and a corresponding exploded view 202 of the speaker-integration system from FIG. 1.

The intermediate structure 122 may have an outer surface 204 that is shaped to substantially conform to a shape of an inner surface of the outer enclosure 108. In addition, the intermediate structure 122 defines a cavity 206 that can be used as a speaker back volume for the speaker 124 for acoustic performance, particularly for lower frequencies. When assembled, the cavity 206 is open toward the cap 140 of the outer enclosure 108.

The speaker 124 may be assembled to the intermediate structure 122 and positioned such that the speaker 124 outputs audio waves toward a back side of the electronic device 100 (e.g., toward the cap 140 of the outer enclosure 108). The cap 140 of the outer enclosure 108 may include one or more holes 208 (e.g., perforations) aligned with the speaker 124 to provide a path for the audio waves to exit the housing. The speaker 124 may be electrically connected to the main logic board 112 via one or more speaker wires 210 passing through or around the intermediate structure 122.

In some aspects, the speaker 124 may be concentrically mounted to the intermediate structure 122 such that the speaker 124 is positioned within the cavity 206 of the intermediate structure 122 and is positioned coaxially or shares a center axis (e.g., center axis 212) with the intermediate structure 122. The speaker 124 may be oriented to use the cavity 206 as a speaker back volume. The intermediate structure 122 may include multiple ribs (e.g., support ribs 214) extending into the cavity 206 toward the center axis 212. These support ribs 214 may be used to support the speaker 124 in an axial direction (e.g., direction parallel to the center axis 212). The support ribs 214 may provide a support force against the gasket 126, rather than the speaker 124 itself, to enable the speaker 124 to have axial movement in and out (e.g., vibration) of the cavity 206.

As described further herein, the gasket 126 seals a front of the cavity 206 around the speaker 124 while the grommet 128 seals a back end of the cavity 206 where the speaker wires 210 pass through a wall of the intermediate structure 122 that defines the cavity 206. By sealing the cavity 206, an acoustic chamber is formed for the speaker 124 to use as its back volume for enhanced performance. In some implementations, a front sealing foam (or adhesive) may be used in addition to, or in place of, the gasket 126 to seal the front of the cavity 206 around the speaker 124. However, the gasket 126 provides a seal that is significantly easier to rework than a foam or adhesive, as described in more detail below.

Figure 3:
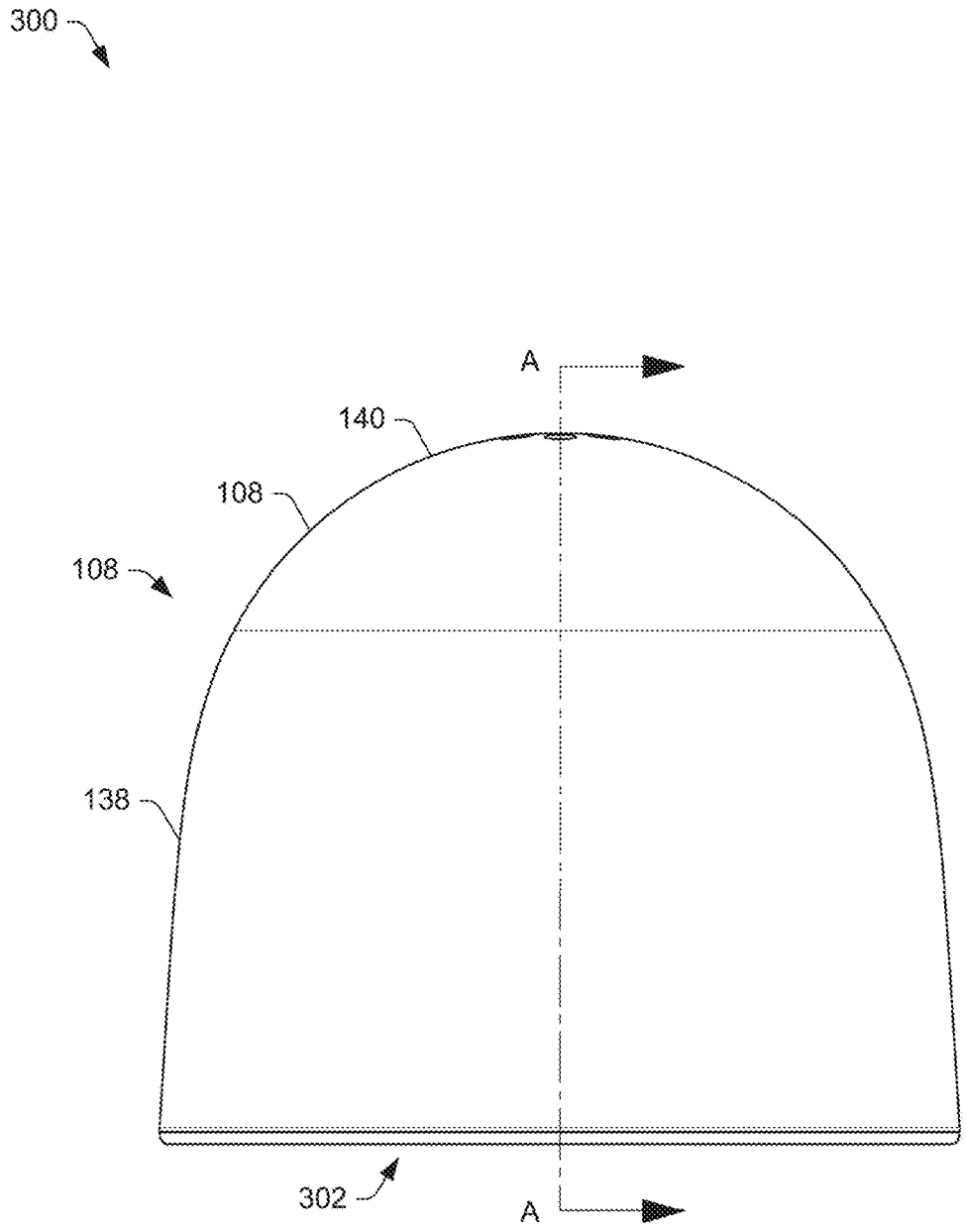
FIG. 3 illustrates a front elevational view of a subassembly of the electronic device from FIG. 1 that includes the example speaker-integration system from FIG. 1 assembled within the outer enclosure.

FIG. 3 illustrates a front elevational view 300 of a subassembly of the electronic device from FIG. 1 that includes the example speaker-integration system from FIG. 1 assembled within the outer enclosure. As illustrated, the outer enclosure 108 has a profile that is tapered from a front end 302 of the shell 138 to the tip of the cap 140.

Figure 4:
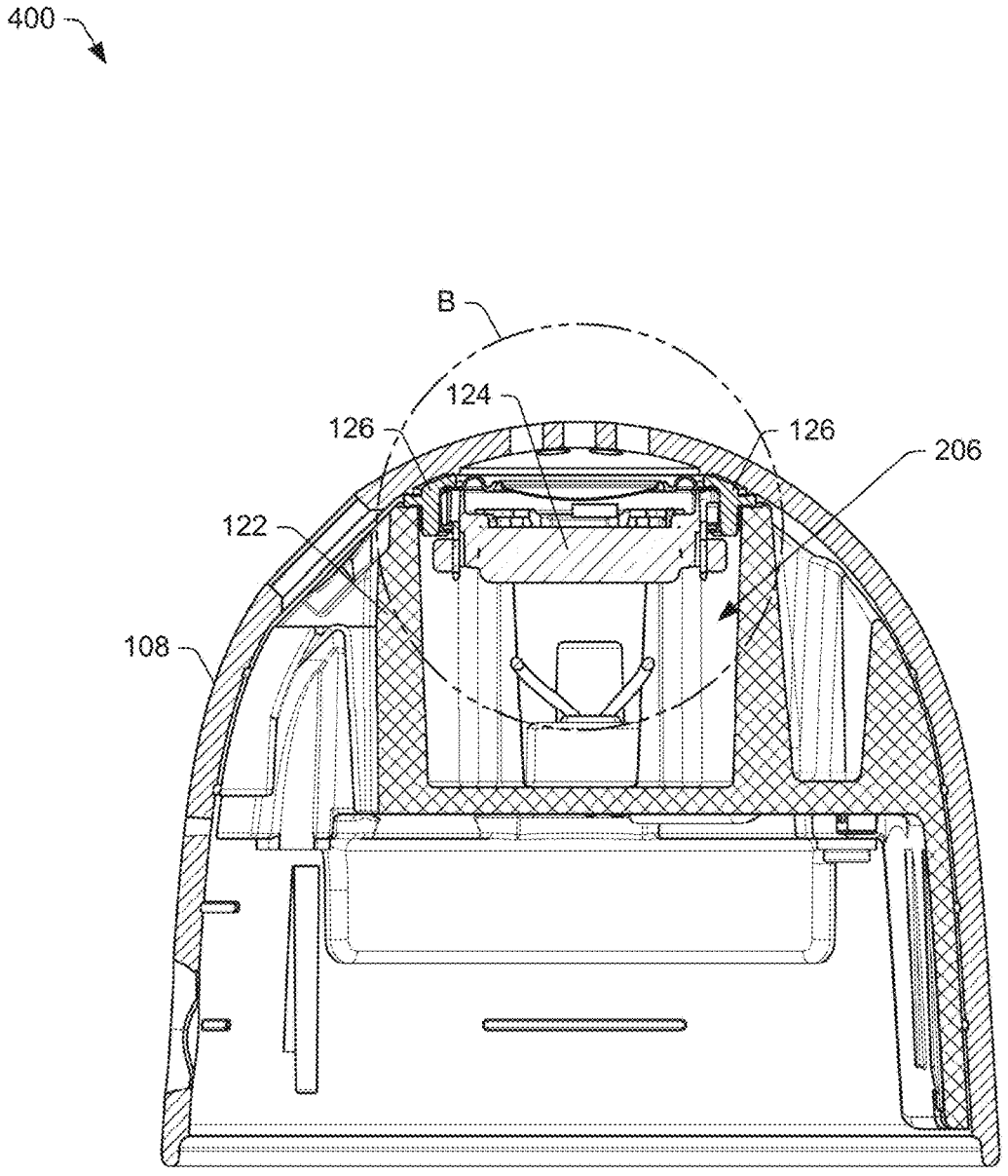
FIG. 4 illustrates a section view of the subassembly of the electronic device from FIG. 3, taken along line A-A, and including a portion of the example speaker-integration system.

FIG. 4 illustrates a section view 400 of the subassembly of the electronic device from FIG. 3, taken along line A-A, and includes a portion of an example speaker-integration system. For simplicity of discussion, some of the components of the electronic device 100, such as those shown in FIG. 1, are not shown in the section view 400. As assembled, the speaker 124 is suspended within the cavity 206, such that the speaker 124 does not contact the intermediate structure 122. The gasket 126 interfaces between the intermediate structure 122 and the outer enclosure 108, and between the speaker 124 and the outer enclosure 108. The gasket secures the speaker 124 within the cavity 206 and resists movement of the speaker 124 in its axial and radial directions. A portion (e.g., portion B) of the subassembly is shown in FIG. 5.

Figure 5:
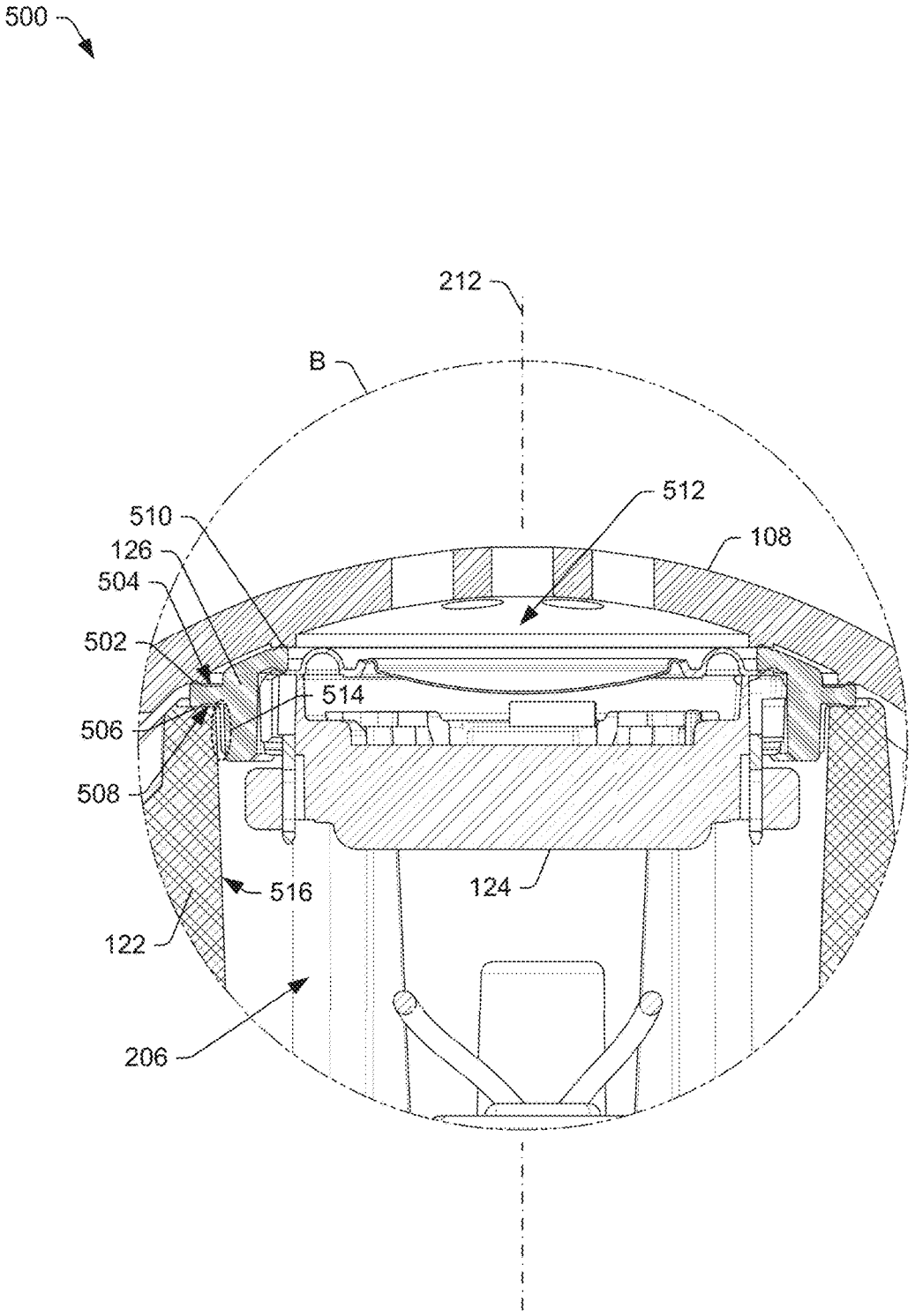
FIG. 5 illustrates an enlarged view of a portion of the section view of FIG. 4, showing an example gasket of the speaker-integration system.

FIG. 5 illustrates an enlarged view 500 of a portion (e.g., portion B) of the section view of FIG. 4, showing an example gasket of the speaker-integration system. The gasket 126 forms a soft surface between the intermediate structure 122 and the outer enclosure 108 and also between the speaker 124 and the outer enclosure 108. In this way, the gasket 126 is secured in place based on a compression force provided by the outer enclosure 108 and the intermediate structure 122 when assembled together. The compression force prevents the gasket 126 from vibrating against hard surfaces of the outer enclosure 108 and the intermediate structure 122.

As illustrated, the gasket 126 includes a first compressible region 502 on a first surface 504 and a second compressible region 506 on a second surface 508 that is opposite the first surface 504. The first compressible region 502 is configured to be compressed by the outer enclosure 108 to form a seal. The second compressible region 506 is configured to be compressed by the intermediate structure 122 to form a seal. Together, the first and second compressible regions 502 and 506, respectively, can be compressed between the outer enclosure 108 and the intermediate structure 122 to seal around a perimeter of the cavity 206.

The gasket 126 also includes a third compressible region 510, which may be compressed by the outer enclosure 108 to seal a speaker front volume 512 between the speaker 124 and the outer enclosure 108. The gasket 126 is also configured to contact (e.g., at contact region 514), in a direction orthogonal to the center axis 212, a cavity wall 516 of the intermediate structure 122. This contact region 514 helps secure the gasket 126 in place at the opening of the cavity 206 based on a compression force against the cavity wall 516 and a coefficient of friction sufficient to resist movement in the direction of the center axis 212. For further discussion of the gasket, consider FIGS. 6A-10.

Figure 6A:
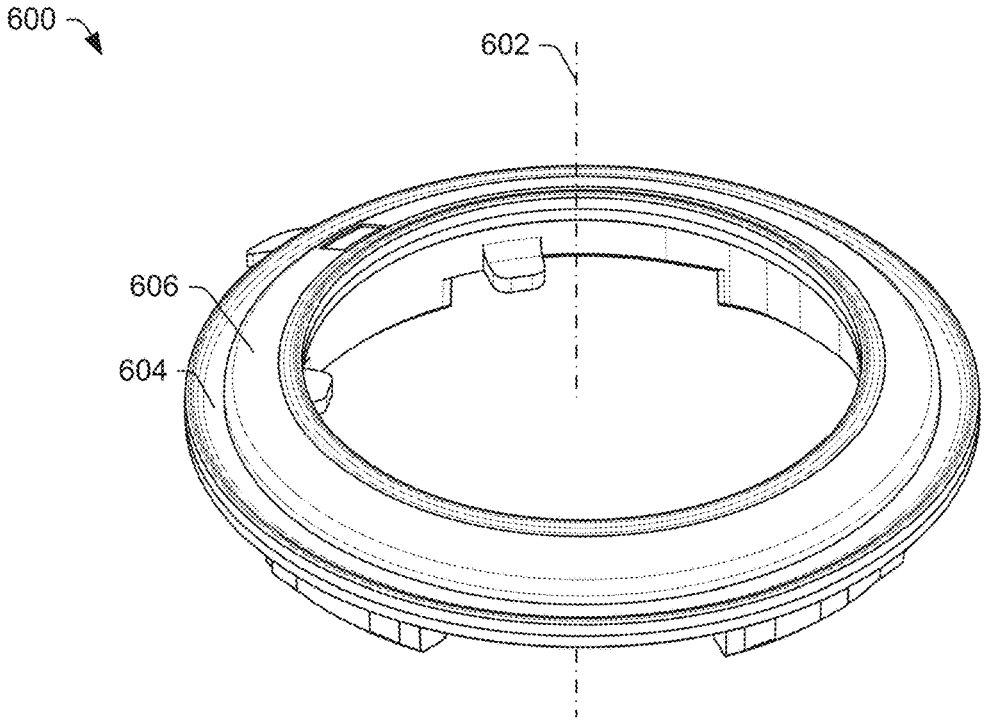
FIG. 6A illustrates a top rear isometric view of the gasket from FIG. 5.
Figure 6B:
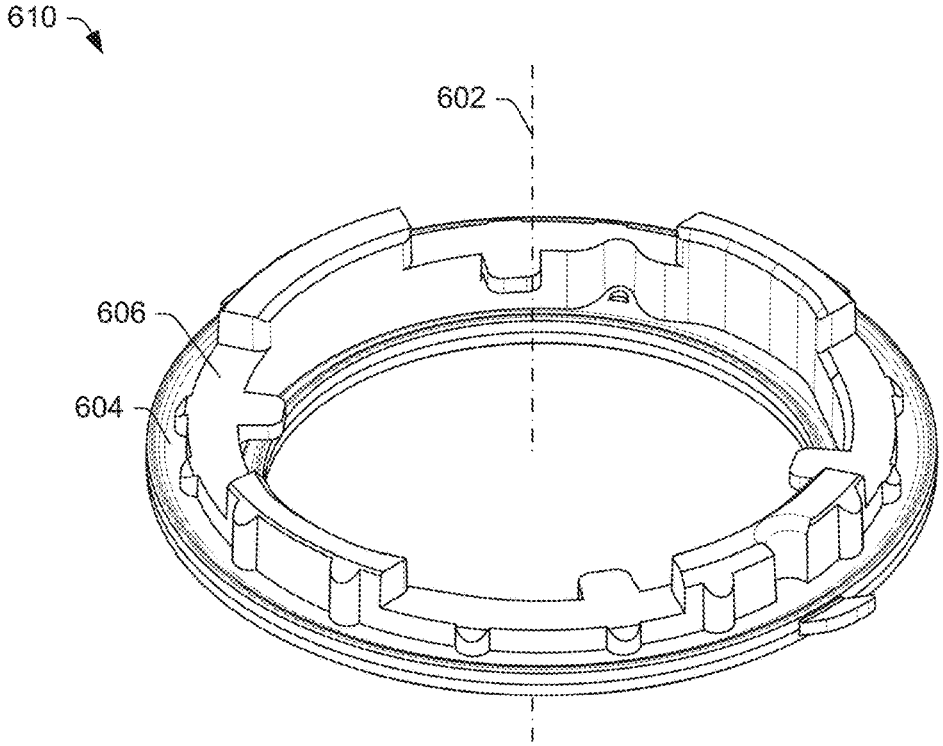
FIG. 6B illustrates a bottom-front isometric view of the gasket from FIG. 5.
Figure 7:
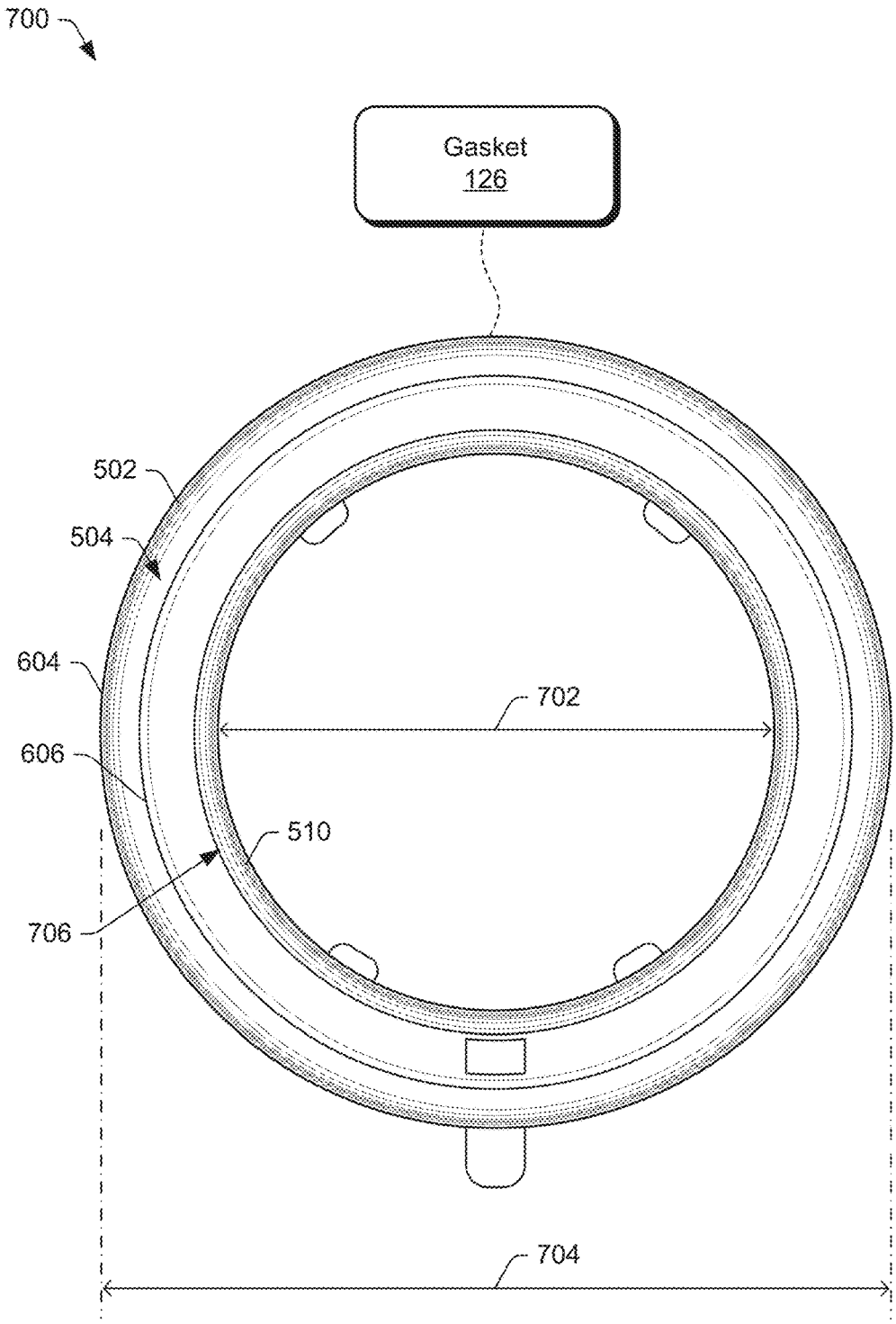
FIG. 7 illustrates a top plan view of the example gasket from FIG. 5.
Figure 8:
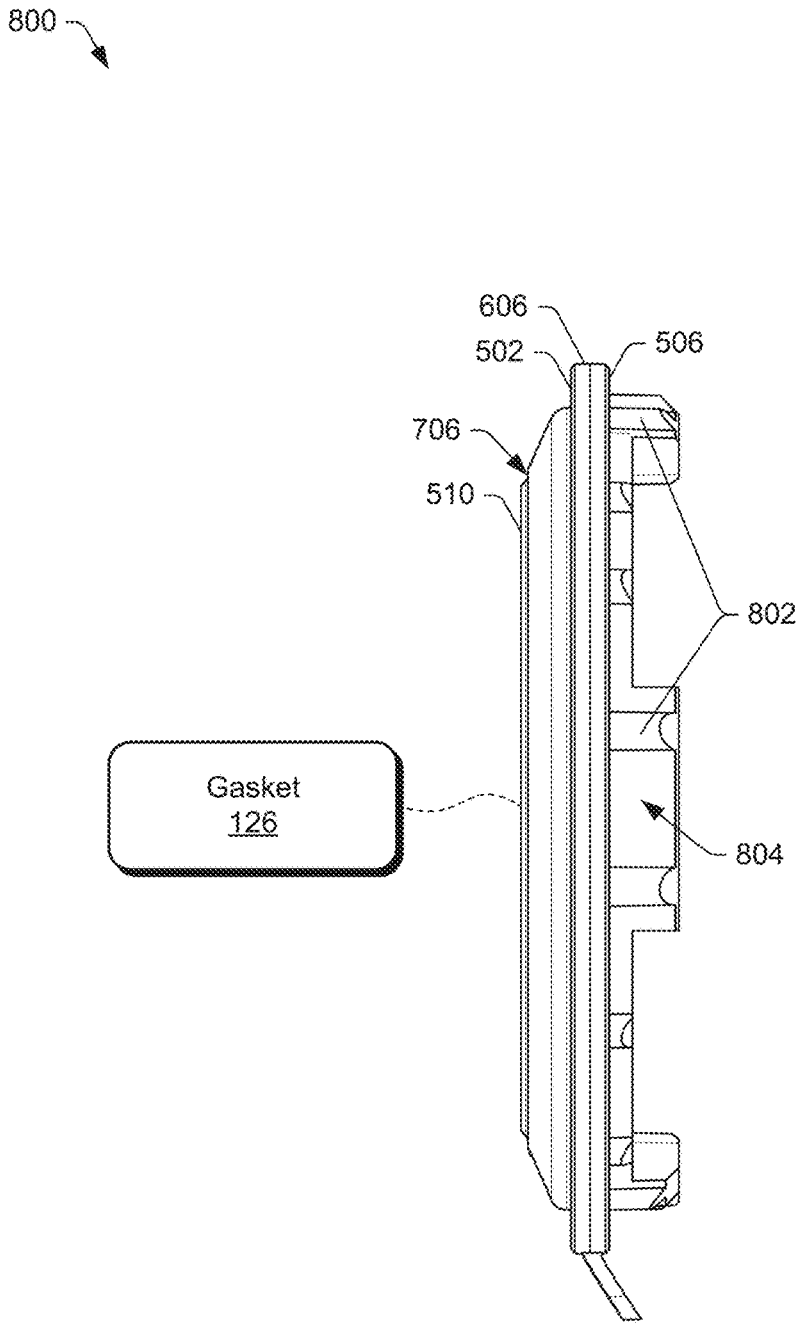
FIG. 8 illustrates a right elevational view of the example gasket from FIG. 7.
Figure 9:
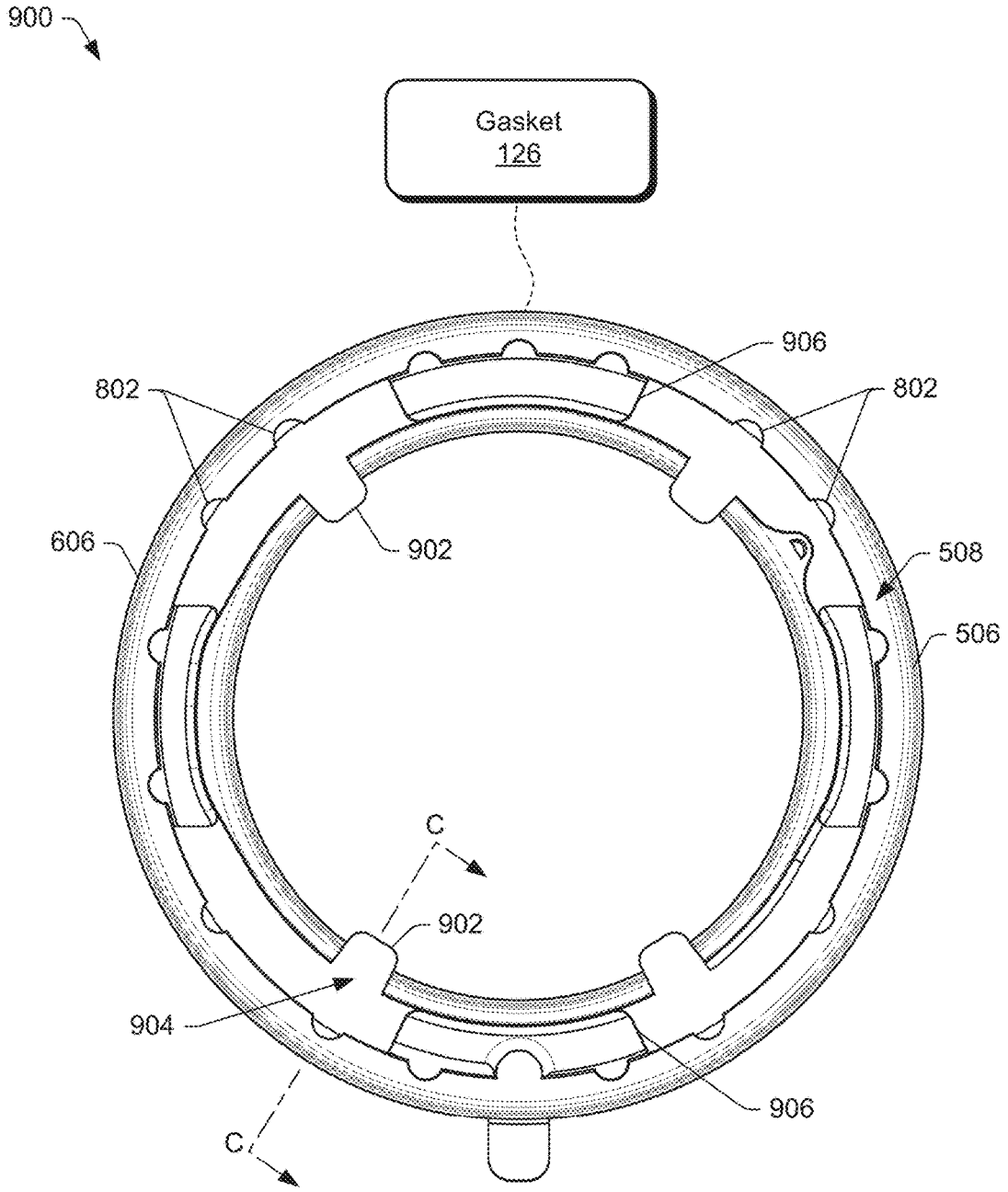
FIG. 9 illustrates a bottom plan view of the example gasket from FIG. 7.
Figure 10:
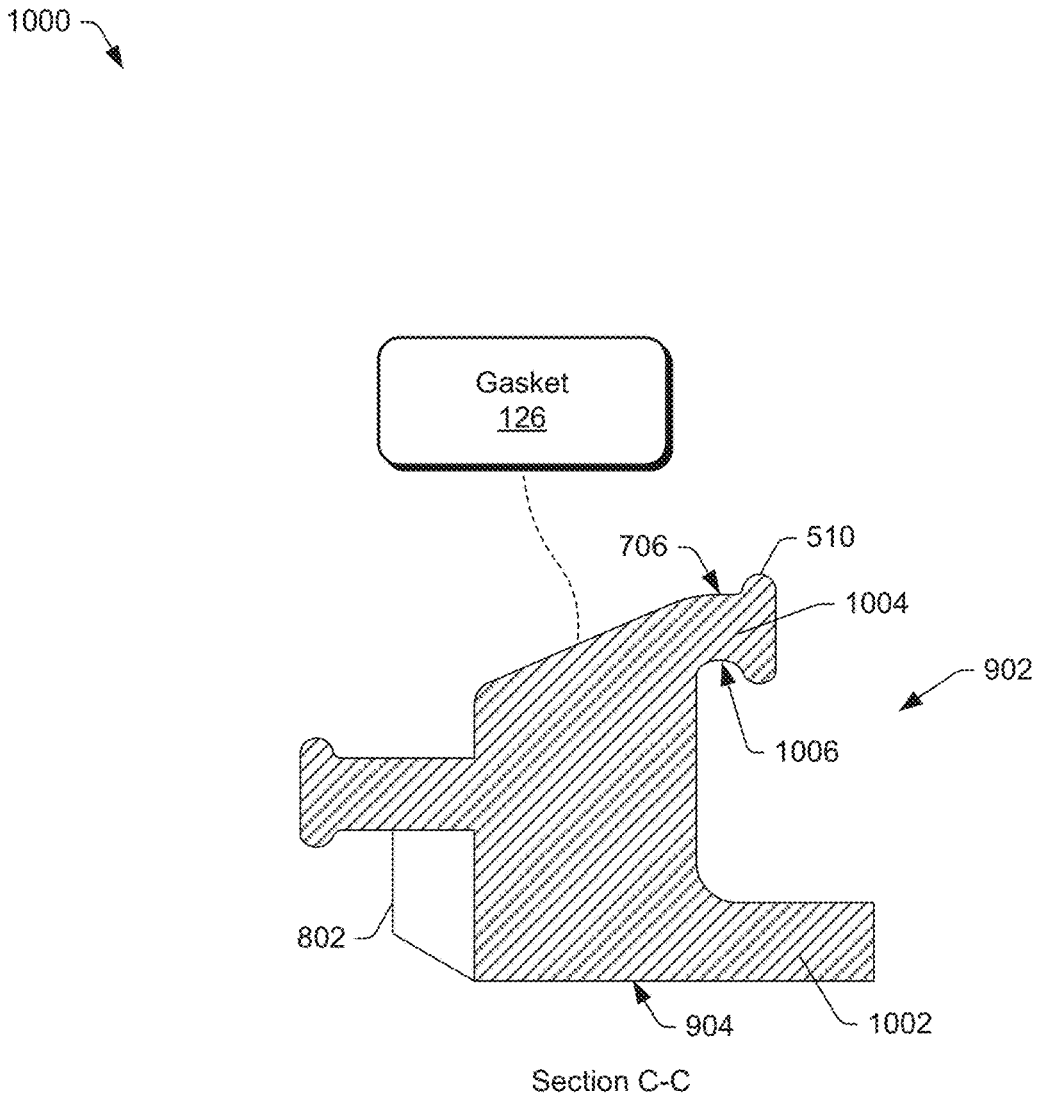
FIG. 10 illustrates a section view of the gasket from FIG. 9, taken along the line C-C.

FIG. 6A illustrates a top-rear isometric view 600 of the example gasket from FIG. 5, and FIG. 6B illustrates a bottom-front isometric view 610 of the example gasket from FIG. 5. FIG. 7 illustrates a top plan view 700 of the example gasket from FIG. 5. FIG. 8 illustrates a right elevational view 800 of the example gasket from FIG. 7. FIG. 9 illustrates a bottom plan view 900 of the example gasket from FIG. 7. FIG. 10 illustrates a section view 1000 of the gasket from FIG. 9, taken along the line C-C.

In FIGS. 6A and 6B, the gasket 126 is illustrated as having a general ring shape with a center axis (e.g., axis 602). In aspects, the gasket 126 includes an inner ring 604 and an outer ring 606. With reference to FIG. 7, the gasket 126 includes an inner diameter 702 and an outer diameter 704. The outer ring 606 includes the first surface 504 and the opposing second surface 508 (shown in FIG. 6). The first compressible region 502 may be located proximate to an outer edge (e.g., the outer diameter 704) of the outer ring 606 and extend outwardly in a direction normal to the first surface 504. In the illustrated example, the first compressible region 502 forms a circle. However, the first compressible region 502 may have any suitable enclosed two-dimensional shape that is configured to form a substantially airtight seal with the outer enclosure.

Similarly, the second compressible region 506 (shown in FIG. 9) is located proximate to the outer edge (e.g., the outer diameter 704) of the outer ring 606 and extends outwardly from the second surface 508 in a direction normal to the second surface 508. As illustrated, the second compressible region 506 also forms a circle. However, the second compressible region 506 may have any suitable enclosed two-dimensional shape that is configured to form a substantially airtight seal with the intermediate structure 122. Returning to FIG. 7, the third compressible region 510 is positioned on a top surface 706 of the inner ring 604, proximate to the inner diameter 702 of the gasket 126. The third compressible region 510 also forms a circle in the illustrated example. However, the third compressible region 510 may have any suitable enclosed two-dimensional shape that is configured to form a substantially airtight seal between the speaker 124 and the outer enclosure 108 to form the speaker front volume 512.

As illustrated in FIG. 8, the first compressible region 502 and the second compressible region 506 are positioned on opposing sides of the outer ring 606, proximate to the outer diameter 704 of the gasket 126. The third compressible region 510 is positioned proximate to the inner diameter 702 of the gasket 126.

In addition, the gasket 126 includes multiple interference ribs (e.g., interference ribs 802), which are distributed radially along a perimeter of the inner ring 604 (e.g., around an outer surface 804 of the inner ring 604) and configured to interfere with the cavity wall 516 (shown in FIG. 5) of the intermediate structure 122. The interference ribs 802 may be positioned proximate to the second surface 508 (shown in FIG. 9) of the outer ring 606. In some aspects, the interference ribs 802 may be connected to the second surface 508 of the outer ring 606. The interference ribs 802 comprise a soft material having a coefficient of friction sufficient to "grip" the cavity wall 516 of the intermediate structure 122 by biasing against the cavity wall 516 when the gasket 126 is assembled to the intermediate structure 122. For example, the gasket 126 is pressed into the cavity 206 and is sandwiched between hard surfaces of the speaker 124 and the cavity wall 516. The gasket 126 resists, using friction, movement in axial and radial directions (e.g., axial direction parallel to the center axis 212 and radial direction about the center axis 212, respectively). The interference ribs 802 also help control the position of the speaker 124 within the cavity 206 (e.g., center the speaker 124 within the cavity 206).

As illustrated in FIG. 9, the gasket 126 may include multiple flexible clips (e.g., clips 902), which are configured to grip a portion of the speaker 124 (e.g., a frame of the speaker 124) to retain the gasket 126 to the speaker 124. The clips 902 each include a planar surface 904, which is configured to abut a respective support rib (e.g., support rib 214 from FIG. 2 positioned within the cavity 206). By abutting the planar surfaces 904 of the clips 902 to the support ribs 214 on the cavity walls 516 (shown in FIG. 2), the gasket 126 is supported in place and the clip 902 is prevented from flexibly opening to release the speaker 124 into the cavity 206. Further, a center post within the cavity 206 is not required to support the speaker 124. Rather, the speaker 124 is supported by the gasket 126 and the support ribs 214 on the cavity walls 516. A section view of the clip 902, taken along line C-C, is illustrated in FIG. 10.

In section view 1000, the clip 902 is illustrated as having a general C-shape usable to grip onto a portion of the speaker 124 to retain the gasket 126 to the speaker 124. The clip 902 is formed of a flexible material to enable removable assembly onto the portion of the speaker 124. The general C-shape of the clip 902 has an opening that is open toward the center of the gasket 126, such that the clip 902 receives the portion of the speaker 124 in a direction that is orthogonal to a center axis (e.g., axis 602 of FIG. 6) of the gasket 126. The clip 902 is positioned directly opposite (in a direction parallel to the axis 602) the third compressible region 510.

The clip 902 includes a flange 1002 that extends inwardly from the inner diameter 702 toward the center of the gasket 126. In aspects, the flange 1002 may be positioned opposite one or more of the interference ribs 802. The flange 1002 forms a lower portion of the clip 902 to support a surface of the speaker 124 that faces the interior of the cavity 206 when assembled. An upper portion of the clip 902 utilizes an extending member 1004 that has the third compressible region 510 on the top surface 706. The extending member 1004 includes a surface (e.g., bottom surface 1006), which is opposite the top surface 706. In some aspects, the bottom surface 1006 includes a lip region 1008. Together, the lip region 1008 (via the extending member 1004) and the flange 1002 are configured to generate a clamping force to grip the portion of the speaker 124 in a manner to form a substantially airtight seal around the speaker 124. Because the interference ribs 802 are positioned opposite the clip 902, the interference ribs 802 can bias against the cavity wall 516 of the intermediate structure 122 to support the clip 902 and reduce the flex of the clip 902 in a direction orthogonal to the center axis 602.

The described gasket 126 enables two different compression forces to be balanced. The first compression force is the combined compression force, by the intermediate structure 122 and the outer enclosure, acting on the first and second compressible regions 502 and 506, respectively, which seals the front of the speaker back volume without using adhesive. The second compression force is the compression force, by the outer enclosure 108, acting on the third compressible region 510, which seals the speaker front volume. The gasket 126 is determined and formed based on the balancing of these compression forces to control the position and orientation of the speaker 124 within the cavity 206, which helps define a size of the speaker back volume and a size of the speaker front volume. The gasket 126 also provides damping to the speaker 124 by constraining the speaker in both axial and radial directions.

Returning to FIG. 9, the gasket 126 includes multiple raised portions 906 proximate to the clips 902 and extending in a direction normal to the planar surface 904 of the clips 902. A respective raised portion 906 is configured to interface with a side of a respective support rib (e.g., support rib 214 in FIG. 2) to prevent radial movement of the gasket 126 about the center axis 602 when assembled to the intermediate structure 122.

Figure 11:
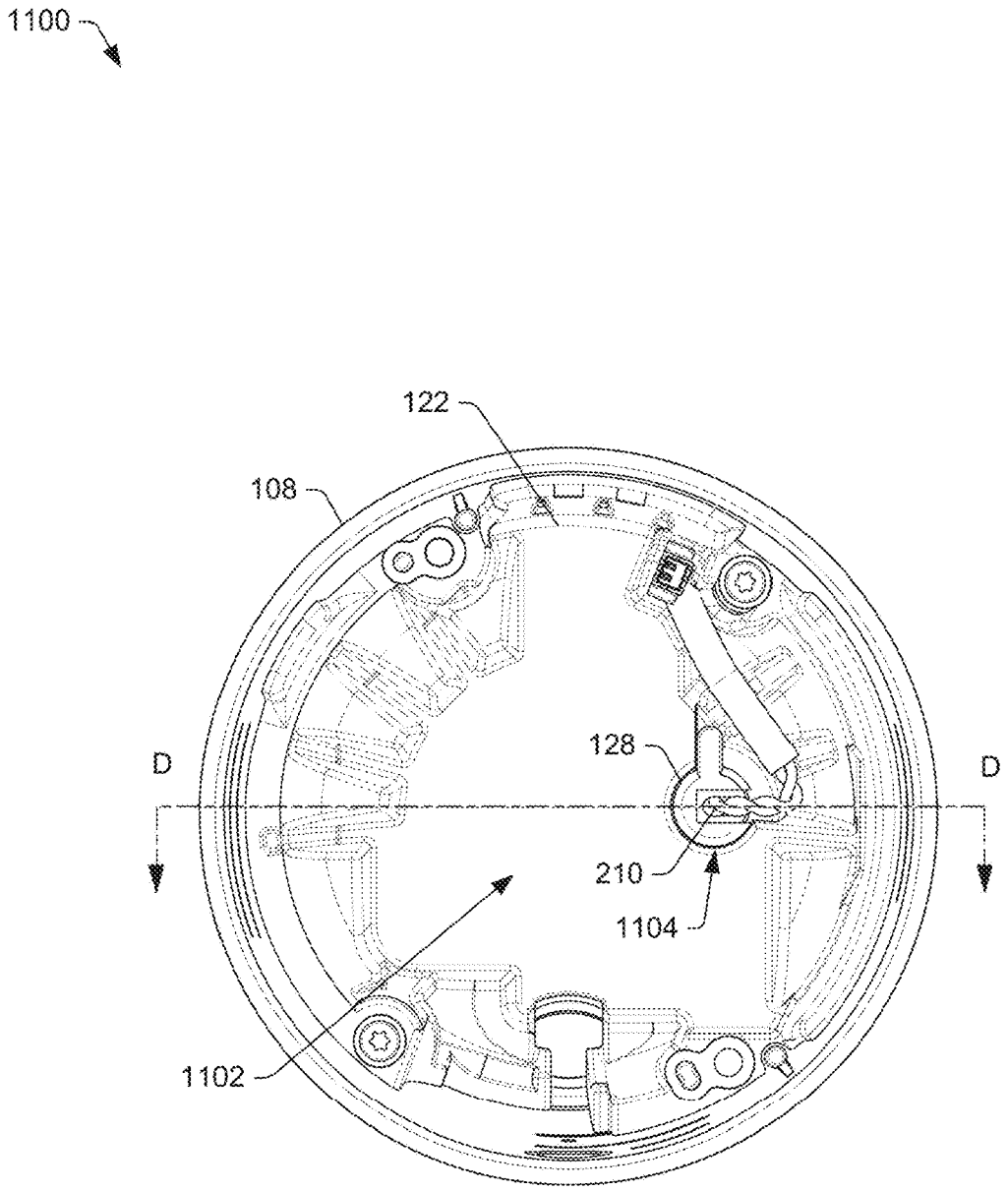
FIG. 11 illustrates a bottom plan view of the subassembly of the electronic device from FIG. 3.

FIG. 11 illustrates a bottom plan view 1100 of the subassembly of the electronic device from FIG. 3. As illustrated, the subassembly includes the intermediate structure 122 assembled into the interior of the outer enclosure 108. The intermediate structure 122 includes a surface 1102 that is substantially planar and faces the main logic board 112 (shown in FIG. 1). The intermediate structure 122 includes a hole 1104, which enables the speaker wires 210 to directly connect the speaker 124 to the main logic board 112. The grommet 128 is positioned within the hole 1104 and forms a seal around the speaker wires 210 extending through the hole 1104 to seal the speaker back volume (e.g., the cavity 206) for the speaker 124.

Figure 12:
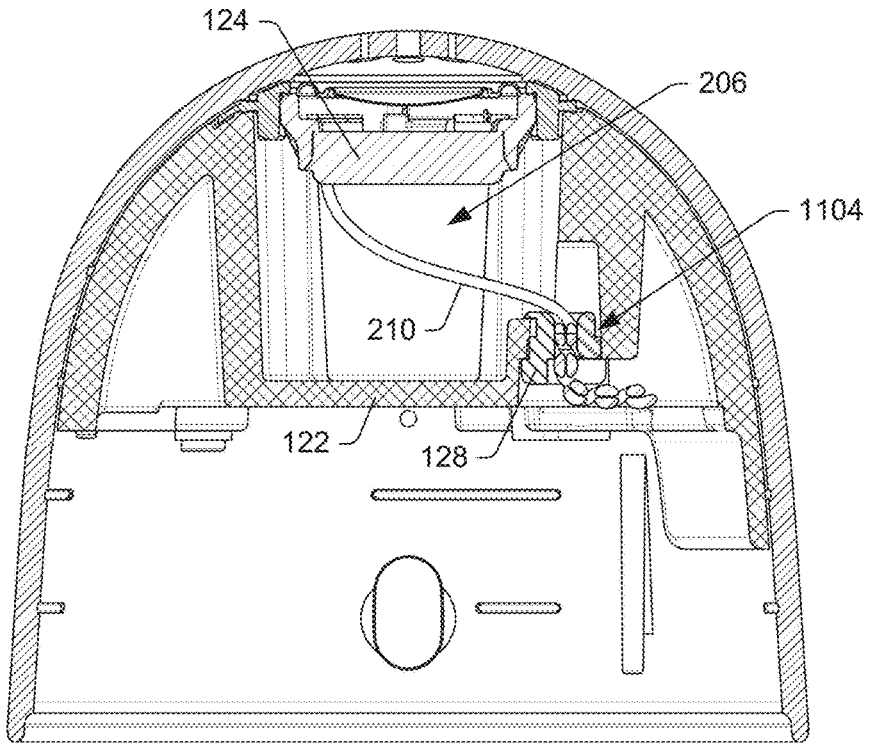
FIG. 12 illustrates a section view of the bottom plan view of the subassembly from FIG. 11, taken along line D-D, and including a portion of an example speaker-integration system.

FIG. 12 illustrates a section view 1200 of the subassembly from FIG. 11, taken along line D-D, and including a portion of the example speaker-integration system. As illustrated, the grommet 128 plugs the hole 1104 in the intermediate structure 122 to seal the back of the cavity 206. The grommet 128 includes a coefficient of friction sufficient to grip the speaker wires 210 and resist movement of the speaker wires 210 through the hole 1104. Because the grommet 128 can tightly grip the speaker wires 210, the grommet 128 and the speaker 124 together secure the speaker wires 210 in a taut position within the cavity 206 to prevent the speaker wires 210 from vibrating against the cavity walls 516. In this way, the grommet 128 controls the position of the speaker wires 210 within the cavity 206. In addition, the grommet 128 controls the position of the speaker wires 210 as they exit the hole 1104.

Figure 13:
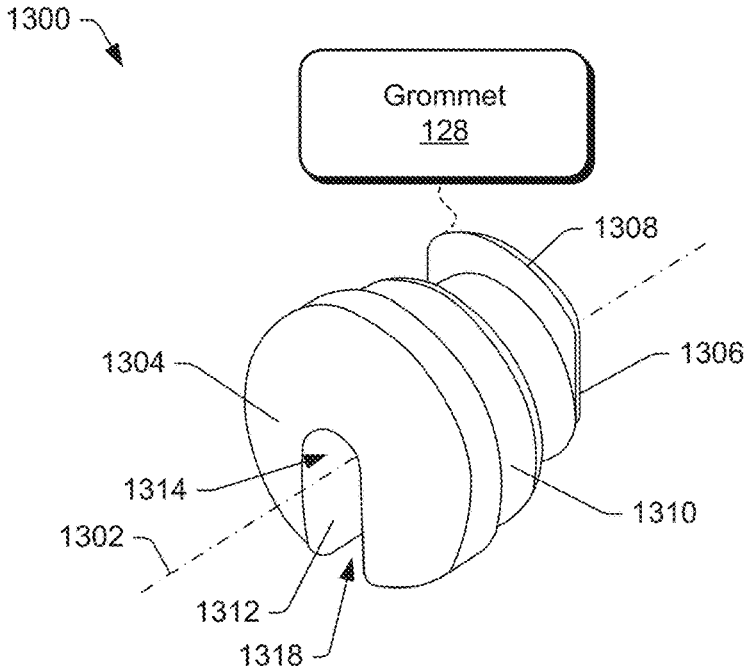
FIG. 13 illustrates a front-right isometric view a rear left isometric view of an example grommet from FIG. 1.
Figure 14:
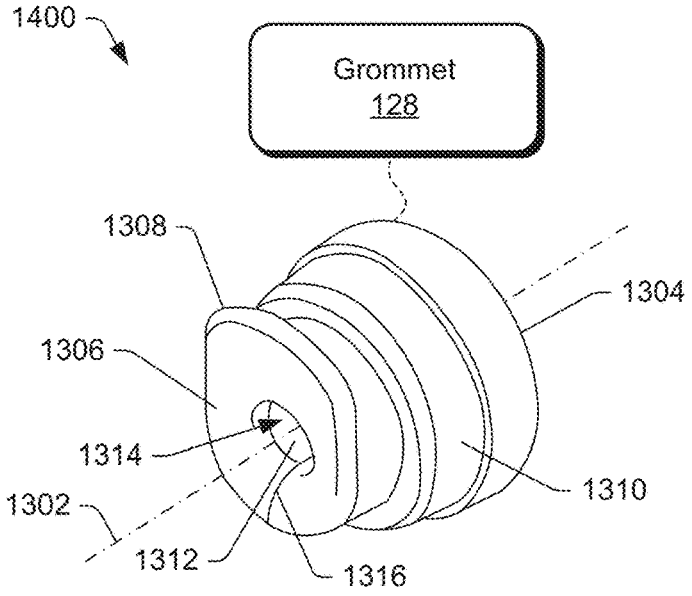
FIG. 14 illustrates a rear-left isometric view of the example grommet from FIG. 13.

FIG. 13 illustrates a front-right isometric view of an example grommet from FIG. 1. FIG. 14 illustrates a rear-left isometric view of the example grommet from FIG. 13. The grommet 128 is illustrated with a longitudinal axis 1302, which intersects a first end 1304 and a second end 1306. The grommet 128 is tapered from the first end 1304 to the second end 1306. The tapering can be any suitable reduction in diameter, including a linear tapering or a stepwise tapering. The grommet 128 may be formed from a flexible material, e.g., an elastomer.

The grommet 128 also includes a flexible flange (e.g., flange 1308) extending radially outward from the second end 1306. This flange 1308 is used to resist axial movement of the grommet through a hole (e.g., the hole 1104 in the intermediate structure 122 shown in FIG. 12). When the grommet 128 is removably assembled (e.g., pressed) into the hole 1104 with the second end 1306 entering the hole 1104 first, the flange 1308 bends inwardly (toward the grommet 128) due to the rigid sides of the hole 1104. When the flange 1002 exits the hole 1104 in the interior of the cavity 206, the flange 1002 extends laterally, relative to the longitudinal axis 1302, to its approximate original position to overlap a portion of a surface of the cavity 206, such as the cavity wall 516. Although the flange 1002 helps secure the grommet 128 in place in the hole 1104, the grommet 128 can be removed with a sufficient amount of force to cause the flange 1002 to bend in outwardly (away from the first end 1304 of the grommet 128) and enable the grommet 128 to be slidably moved (e.g., pulled) from the hole 1104 in a direction toward the first end 1304.

The grommet 128 includes an outer surface 1310 and also an inner surface 1312 defining a center hole 1314 through which the speaker wires 210 may extend. The hole 1314 is coaxial with the longitudinal axis 1302. The grommet 128 also includes a disconnected section (e.g., cut 1316) from the outer surface 1310 to the inner surface 1312 and from the first end 1304 to the second end 1306. The cut 1316 enables the grommet 128 to be flexibly opened to wrap around the speaker wires 210. In aspects, the grommet 128 may be molded as one continuous part and then subsequently sliced with a blade to create the cut 1316. Alternatively, the grommet 128 may be molded with the disconnected section (e.g., the cut 1316) already in place. Because of the cut 1316, the speaker wires 210 are not required to be threaded through the center hole 1314. Rather, the grommet 128 can be opened up to receive a length of the speaker wire 210 and then closed around the speaker wire 210. In addition, the grommet 128 includes a friction coefficient sufficient to enable the grommet 128 to resist slidable movement of the speaker wires 210 through the center hole 1314 in the grommet 128.

The grommet 128 also defines a slot 1318 in the first end 1304 to enable the speaker wires 210 exiting the grommet 128 to be bent up to approximately 90 degrees. An example of the speaker wire 210 being routed through the grommet 128 and turned upon exiting the first end 1304 of the grommet 128 is shown in FIG. 12. This helps to prevent the speaker wires 210 from rubbing or buzzing against one or more nearby components of the electronic device 100 that are proximate to the first end 1304 of the grommet 128. Accordingly, based on the geometry and material of the grommet, the grommet 128 controls axial and radial positions of the speaker wire 210.

CONCLUSION

Although aspects of the speaker-integration system for an electronic device have been described in language specific to features and/or methods, the subject of the appended claims is not necessarily limited to the specific features or methods described. Rather, the specific features and methods are disclosed as example implementations of the claimed speaker-integration system or a corresponding electronic device, and other equivalent features and methods are intended to be within the scope of the appended claims. Further, various different aspects are described, and it is to be appreciated that each described aspect can be implemented independently or in connection with one or more other described aspects.

What is claimed is:

1. A speaker-integration system for an electronic device, the speaker-integration system comprising:

an intermediate structure mountable to an outer enclosure of the electronic device, the intermediate structure forming a cavity;

a speaker positioned within the cavity of the intermediate structure and oriented to use the cavity as a speaker back volume;

a grommet removably positioned within a hole in a wall of the cavity of the intermediate structure, the grommet configured to form a seal around one or more speaker wires passing through the hole; and a gasket removably positioned to secure the speaker within the cavity, the gasket configured to:

form a seal around the speaker at an opening of the cavity to seal the opening of the cavity; and form a seal between the intermediate structure and the outer enclosure.

2. The speaker-integration system of claim 1, wherein:

the grommet is tapered from a first end toward a second end;

the grommet includes a flexible flange extending radially outward from the second end to resist axial movement of the grommet through the hole; and the axial movement includes movement in a direction substantially parallel to a direction of a longitudinal axis of the grommet.

3. The speaker-integration system of claim 2, wherein the grommet includes:

an outer surface and an inner surface that is opposite the outer surface; and a cut from the outer surface to the inner surface and from the first end to the second end to enable the grommet to be flexibly opened to wrap around the one or more speaker wires.

4. The speaker-integration system of claim 1, wherein the grommet is configured to secure the one or more speaker wires in axial and radial directions of the one or more speaker wires to control a direction of the one or more speaker wires as the one or more speaker wires exit the hole.

5. The speaker-integration system of claim 1, wherein the grommet has a coefficient of friction sufficient to enable the grommet to resist slidable movement of the speaker wires through a center hole in the grommet.

6. The speaker-integration system of claim 1, wherein the gasket secures the speaker between the intermediate structure and the outer enclosure.

7. The speaker-integration system of claim 1, wherein the gasket is positioned to secure the speaker by securing a frame of the speaker in axial and radial directions of the speaker to control a position of the speaker within the cavity.

8. The speaker-integration system of claim 1, wherein the gasket includes multiple ribs distributed along a perimeter of an outer ring of the gasket to bias against a cavity wall of the cavity and secure the speaker within the cavity.

9. The speaker-integration system of claim 1, wherein the gasket includes multiple flexible clips that are each configured to grip a portion of the speaker to retain the gasket to the speaker.

10. The speaker-integration system of claim 9, wherein a respective clip has a general C-shape having an opening that receives the portion of the speaker in a direction orthogonal to a center axis of the gasket and resists movement of the speaker in an axial direction that is parallel to the center axis.

11. The speaker-integration system of claim 10, wherein the gasket includes one or more ribs positioned opposite the opening of the respective clip, the one or more ribs configured to bias against a cavity wall of the cavity to support the respective clip and reduce a flex of the respective clip.

12. The speaker-integration system of claim 10, wherein the respective clip includes a planar surface that is:

substantially orthogonal to the center axis; and is configured to abut a support rib, which extends inwardly from the wall of the cavity toward the center axis, to support the grip of the respective clip on the portion of the speaker and prevent the respective clip from flexibly opening to release the speaker.

13. The speaker-integration system of claim 12, wherein the gasket includes at least one raised portion proximate to the multiple flexible clips and extending in a direction normal to the planar surface of the multiple flexible clips, a respective raised portion configured to interface with a side of a respective support rib to prevent radial movement of the gasket about the center axis when assembled to the intermediate structure.

14. The speaker-integration system of claim 1, wherein the gasket is configured to seal a front of the back volume without using adhesive.

15. An electronic device comprising:

an outer enclosure forming a shell with a cap;

an intermediate structure positioned within the outer enclosure, the intermediate structure having an outer surface that substantially conforms to a shape of an inner surface of the outer enclosure, the intermediate structure defining a cavity that is open toward the cap;

a speaker positioned within the cavity and facing the cap of the outer enclosure;

a gasket having:

an outer ring that extends radially outward from an inner ring of the gasket, the outer ring having a first compressible region on a first surface and a second compressible region on a second surface that is opposite the first surface, the first and second compressible regions configured to be compressed between the outer enclosure and the intermediate structure to form a first seal;

a third compressible region on the inner ring and configured to be compressed between the outer enclosure and the speaker to form a second seal; and one or more clips configured to grip a portion of the speaker to control a position and orientation of the speaker within the cavity; and a grommet positioned within a hole in the intermediate structure and forming a third seal, the grommet wrapped around one or more speaker wires extending through the hole.

16. The electronic device of claim 15, wherein:

the grommet is tapered from a first end toward a second end;

the grommet includes a flexible flange extending radially outward from the second end to resist axial movement of the grommet through the hole; and the axial movement includes movement in a direction parallel to a direction of a longitudinal axis of the grommet.

17. The electronic device of claim 15, wherein the grommet is configured to control axial and radial directions of the one or more speaker wires as the one or more speaker wires exit the hole.

18. The electronic device of claim 15, wherein the gasket is positioned to secure the speaker by securing a frame of the speaker in axial and radial directions of the speaker to control a position of the speaker within the cavity.

19. The electronic device of claim 15, wherein the gasket includes multiple ribs distributed along a perimeter of an outer ring of the gasket to bias against a cavity wall of the cavity of the intermediate structure and secure the speaker within the cavity.

20. The electronic device of claim 15, wherein a respective clip has a general C-shape having an opening that receives the portion of the speaker in a direction orthogonal to a center axis of the gasket and prevents movement of the speaker in an axial direction that is parallel to the center axis.

21. The electronic device of claim 20, wherein the gasket includes one or more ribs positioned opposite the opening of the respective clip, the one or more ribs configured to bias against a wall of the cavity to support the clip and reduce a flex of the clip.

22. The electronic device of claim 21, wherein the respective clip includes a planar surface that is:

substantially orthogonal to the center axis; and is configured to abut a support rib, which extends inwardly from the cavity wall of the cavity toward the center axis, to support the grip of the clip on the portion of the speaker and prevent the clip from flexibly opening to release the speaker.

23. The electronic device of claim 22, wherein the gasket includes multiple raised portions proximate to the one or more clips and extending in a direction normal to the planar surface of the one or more clips, a respective raised portion configured to interface with a side of a respective support rib to prevent radial movement of the gasket about the center axis when assembled to the intermediate structure.

* * * * *